US011339649B2

(12) United States Patent
Sauthoff et al.

(10) Patent No.: US 11,339,649 B2
(45) Date of Patent: May 24, 2022

(54) RADIAL SHEAR VALVE FOR MUD PULSER

(71) Applicant: Baker Hughes, Houston, TX (US)

(72) Inventors: Bastian Sauthoff, Burgdorf (DE); Arne Deiters, Celle (DE); Jens Teuchgraber, Hannover (DE); Thomas Wettmarshausen, Hannover (DE)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 16/509,283

(22) Filed: Jul. 11, 2019

(65) Prior Publication Data

US 2020/0018157 A1 Jan. 16, 2020

Related U.S. Application Data

(60) Provisional application No. 62/698,659, filed on Jul. 16, 2018.

(51) Int. Cl.
*E21B 47/18* (2012.01)
*E21B 34/06* (2006.01)

(52) U.S. Cl.
CPC ..... *E21B 47/18* (2013.01); *E21B 34/06* (2013.01)

(58) Field of Classification Search
CPC ..... E21B 47/12; E21B 47/18; E21B 47/182; E21B 47/185; E21B 47/187; E21B 34/06; E21B 47/20; E21B 47/22; E21B 47/24
See application file for complete search history.

(56) References Cited

U.S. PATENT DOCUMENTS 3,982,224 A 9/1976 Patton
5,586,083 A * 12/1996 Chin ..... E21B 47/18 367/84
6,219,301 B1 4/2001 Moriarty
6,636,159 B1 10/2003 Winnacker
(Continued)

FOREIGN PATENT DOCUMENTS

EP 2647791 A2 10/2013
WO 2017069751 A1 4/2017
WO 2017079829 A1 5/2017

OTHER PUBLICATIONS

ISR and Written Opinion in PCT/US2019/041613, dated Nov. 6, 2019.
IPRP in PCT/US2019/041613 dtd Jan. 19, 2021.

*Primary Examiner* — Franklin D Balseca
(74) *Attorney, Agent, or Firm* — Mossman, Kumar & Tyler, PC

(57) ABSTRACT

An apparatus for generating pressure variances in a flowing fluid includes a first member having a body and a second member. The second member is displaceable about a rotational axis to at least partially block fluid flow through one or more channels in the first member and at least partially reduce the blockage of this fluid flow. The second member has a hub and at least one section extending axially and radially from the hub relative to the rotational axis of the second member. A related method includes guiding fluid across the first member using the channel(s); selectively blocking the fluid flow through the channel(s) using at least one section of a second member; and moving the second member using an actuator to reduce the blockage of the flow of fluid through the channel(s).

20 Claims, 5 Drawing Sheets

(56) References Cited

U.S. PATENT DOCUMENTS

| | | | | |
|---|---|---|---|---|
| 7,719,439 | B2 * | 5/2010 | Pratt | E21B 47/187 175/40 |
| 9,316,072 | B2 * | 4/2016 | Rogers | F16K 3/085 |
| 9,840,910 | B2 * | 12/2017 | Lee | G01V 1/52 |
| 2002/0117603 | A1 | 8/2002 | McCracken | |
| 2006/0034154 | A1 | 5/2006 | Perry et al. | |
| 2013/0250728 | A1 | 9/2013 | Burgess | |
| 2015/0233238 | A1 | 8/2015 | Logan et al. | |
| 2017/0051610 | A1 | 2/2017 | Sitka et al. | |
| 2017/0130578 | A1 | 5/2017 | Skerry | |
| 2018/0128099 | A1 | 5/2018 | Barbely | |
| 2018/0291733 | A1 * | 10/2018 | Ritchie | E21B 47/24 |
| 2020/0003050 | A1 * | 1/2020 | Lee | E21B 47/18 |
| 2020/0072005 | A1 * | 3/2020 | Sauthoff | E21B 49/003 |

* cited by examiner

RADIAL SHEAR VALVE FOR MUD PULSER

CROSS-REFERENCE TO RELATED APPLICATIONS

This application claims priority from U.S. Provisional Application Ser. No. 62/698,659 filed on Jul. 16, 2018, the entire disclosure of which is incorporated herein by reference in its entirety.

BACKGROUND OF THE DISCLOSURE

1. Field of the Disclosure

The disclosure relates generally to systems and methods for generating pressure pulses that transmit information along a borehole.

2. Description of the Related Art

Drilling fluid telemetry systems, generally referred to as mud pulse systems, are particularly adapted for telemetry of information from the bottom of a borehole to the surface of the earth during oil well drilling operations. The information telemetered may include, but is not limited to, parameters of pressure, temperature, direction and deviation of the well bore. Other parameters include logging data such as resistivity of the various layers, sonic density, porosity, induction, and pressure gradients. Valves that use a controlled restriction placed in the circulating mud stream are commonly referred to as positive pulse systems, which close a fluid path.

One type of positive pulsing valve uses rotating disks as shown in FIGS. 1A, B. The valves 10*a,b* include one or more blades 12 that at least partially restrict the drilling mud flowing along a tool axis direction, which is into or out of the page, and a stator 14 having one or more orifices 16. Each blade 12 has a radially extending edge 18 that cuts and shears the fluid, which is flowing axially straight. The flow cross-sectional area of such valve configurations may be difficult to optimally design due to the design restrictions imposed by the number of blades 12 and orifices 16, the geometric design of the orifices 16 in a stator 14, and the size/shape of the blades 12 in relation to the orifices 16.

For example, drilling operations with different flow rates conventionally require the use of differently configured valves. For high flow rates, the valve 10*a*, as shown in FIG. 1A, is used to provide a large flow cross section to reduce the resistance of the valve 10*a* to flow during non-signal transmission periods. This can be done only by using a small number of blades and wide flow cross-sections. Referring to FIG. 1B, for low flow rates, a valve 10*b* with a large number of blades and small flow cross-sections is used to enable a nearly full reduction of the flow cross-section to achieve a pressure drop for sufficient magnitude to be detected at a downstream location.

Conventionally, the high-flow rate valve 10*a* cannot be used for low flow applications because the blades 12 are much smaller than the orifices 16, which leaves a large gap during the closed position. This large gap prevents low fluid flow from creating a pressure pulse of sufficient amplitude to be detected. Likewise, the low-flow rate valve 10*b* cannot be used for high flow applications because the blades 12 are only slightly smaller, if not larger, than the orifices 16, which leaves little or no gap during the closed position. Thus, high fluid flow generates a corresponding high pressure differential during the closed position, which could damage equipment.

This disclosure provides, in part, valves that addresses these and other drawbacks of the prior art.

SUMMARY OF THE DISCLOSURE

In aspects, the present disclosure provides an apparatus for generating pressure variances in a fluid flowing in a downhole tool. The apparatus may include a first member having a body through which at least one channel is formed and a second member arranged with the first member. The second member may be configured to be displaceable about a rotational axis between a first position in which the second member at least partially blocks the flow of the fluid through the at least one channel of the first member, and a second position in which the second member reduces the at least partial blockage of the flow of the fluid through the at least one channel of the first member. The second member may have a hub and at least one section extending axially and radially from the hub relative to the rotational axis of the second member.

In aspects, the present disclosure also provides a method for generating pressure variances in a fluid flowing in a downhole tool. The method may include the steps of guiding fluid across a first member using at least one channel formed between an inner surface and an outer surface of the first member; selectively blocking the flow of fluid through the at least one channel using at least one section of a second member arranged with the first member, the at least one section extending axially and radially from the hub of the second member relative to a rotational axis of the second member; and moving the second member using an actuator to at least partially reduce the blockage of the flow of fluid through the at least one channel.

It should be understood that examples of certain features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION

The present disclosure relates to devices and methods for enabling communication via pressure variations in a flowing fluid. Illustrative embodiments are systems and related methods for generating pressure pulses in a fluid circulated in a wellbore. These embodiments may include a first member arranged with a second member such that second member is displaceable about a rotational axis and can vary an amount of blockage in fluid flow through the first member. For example, in embodiments, a shear valve has a stator, the first member, and at least one blade, the second member. The blade(s) shear the fluid flow in a direction that is non-perpendicular to a longitudinal axis of a tool. Such embodiments allow the scaling of the cross-sectional flow area independent of the number of blades, thereby supporting a wide range of flow rates. While the present disclosure is discussed in the context of a hydrocarbon producing well, it should be understood that the present disclosure may be used in any borehole environment (e.g., a geothermal well).

An apparatus as described herein may be used to generate pulses in a fluid column within a downhole well to facilitate mud pulse telemetry. This terminology embraces communication through pulses in a fluid column of any kind that may be in a well. An example of such use is for the apparatus to be placed in a drill string together with MWD or LWD tools, to communicate data from the MWD/LWD tools upwardly and to the surface through the fluid column that is flowing downwardly through the drill string to exit via the drill bit. The pulses may be detected and decoded at the surface, thereby communicating data from tools or other sensors in the bottom whole assembly (BHA), or elsewhere in the drill string. The described apparatus opens and closes fluid passages to create pulses in the fluid column of a selected duration and pattern which are detectable at the surface.

Figure 1A:
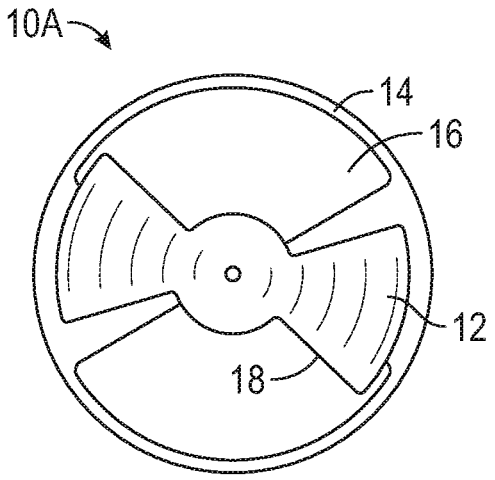
FIG. 1A (Prior Art)
FIGS. 1A, B illustrate end views of prior art shear valves.
Figure 1B:
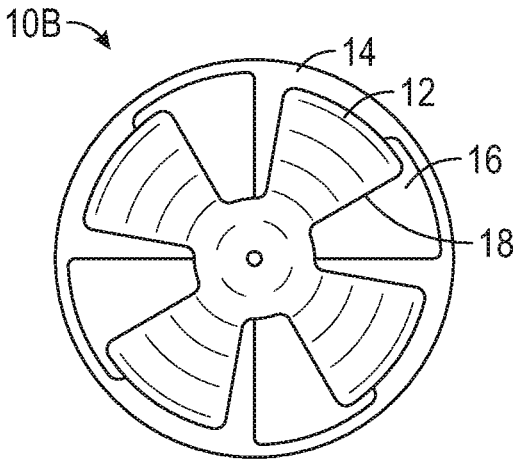
FIG. 1B (Prior Art)
Figure 2:
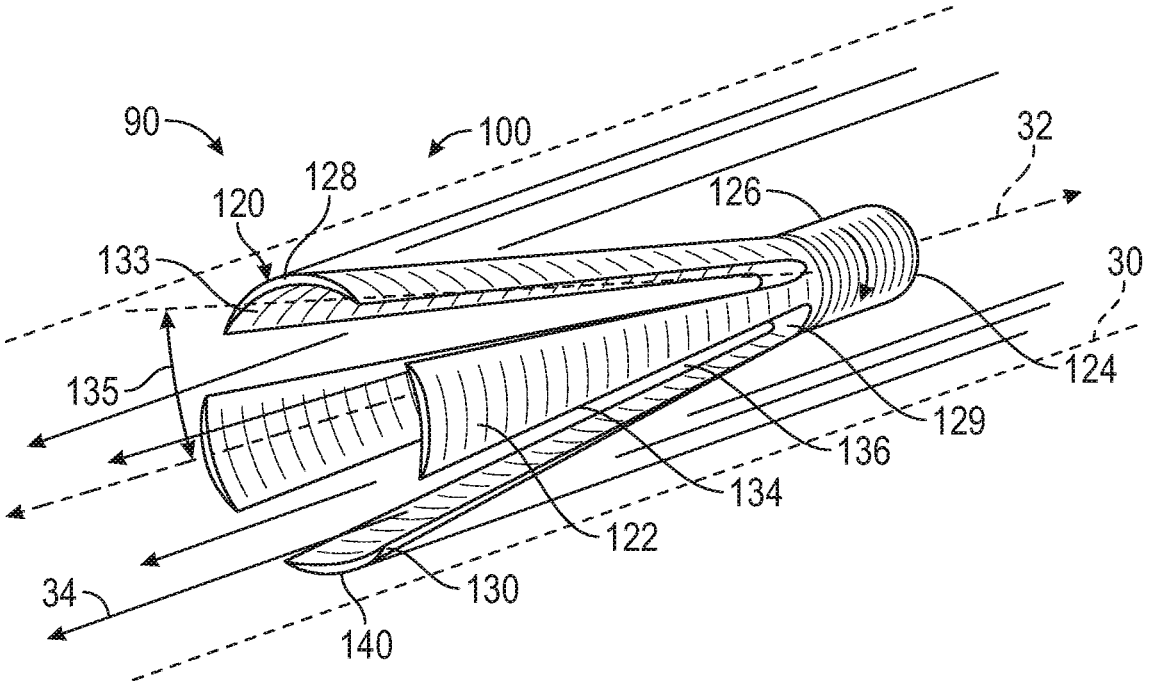
FIG. 2 is an isometric view of a rotor according to one embodiment of the present disclosure.
Figure 3:
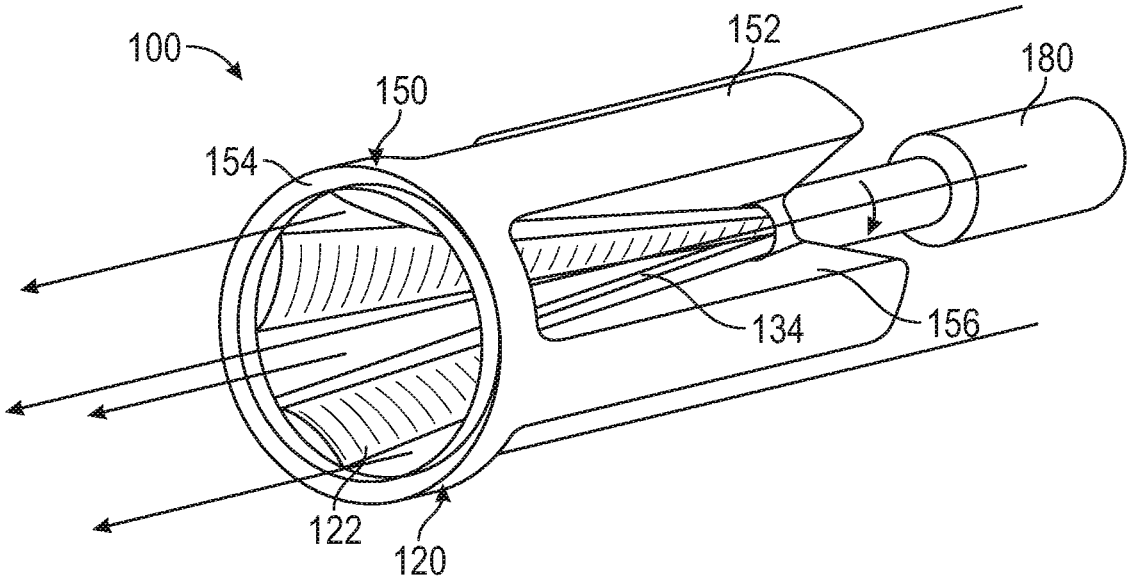
FIG. 3 is an isometric view of a valve according to one embodiment of the present disclosure.

Referring now to FIG. 2, a pulse generator 90 in accordance with one embodiment of the present disclosure may include a valve 100 having a rotor 120 positioned in a section of a drill string 30, which is shown in hidden lines. The pulse generator 90 may also include an actuator 180 (FIG. 3). For the purposes of the present disclosure, an axial direction is a direction along a rotational axis 32 of the rotor 120. A drilling fluid 34 flows generally parallel to the rotational axis 32. For ease of explanation, a stator in which the rotor 120 is disposed is not shown.

The rotor 120 may include one or more blades 122 that radiate from a hub 124. In the illustrated embodiment, there are a plurality of blades 122 that are circumferentially distributed around the hub 124 and which extend both axially along the rotational axis 32 and radially, or perpendicular to the rotational axis 32. The rotational axis 32 may also be the longitudinal axis of the drill string 30. Each blade 122 extends between a base 129 and a terminal end 130.

In one non-limiting arrangement, the blades 122 may be arranged to give the rotor 120 a conical shape. The conical shape may be at least partially defined by a first, smaller diameter 126 at the bases 129 of the blades 122 and a second larger diameter 128 at the opposing terminal ends 130. The smaller and larger diameters 126, 128 are spaced apart along the rotational axis 32. It should be understood that the diameters do not imply that a circular arrangement for the blades 122 is required. Rather, the diameters 126, 128 merely characterize the distance of each of the opposing ends 129, 130 of the blades 122 from the rotational axis 32. Another way to characterize the distances is by using a radius; i.e., a radius from the rotational axis 32 to the base 129 is shorter than a radius from the rotational axis 32 to the tip 130, the radii being perpendicular to the rotational axis 32.

Where a plurality of blades are distributed from the hub of the rotor, the blades may be of the same or different length. In one non-limiting embodiment, the blades are of the same length. In another non-limiting embodiment, the blades are of different length. Where a plurality of blades are distributed from the hub of the rotor, the blades may be distributed from the hub at positions corresponding to the same hub diameter or different hub diameters. A first blade may have a base arrayed at a first hub diameter and a terminal end arrayed at a second larger diameter, and a second blade may have a base arrayed at a third hub diameter and a terminal end arrayed at a fourth larger diameter. The second and fourth diameters are spaced apart along the rotational axis of the rotor relative to the first and third diameters respectively, the first and third diameters can be the same or different, and the second and fourth diameters can be the same or different. In yet another non-limiting embodiment where a plurality of blades are distributed from the hub of the rotor, the blades may be of the same or different length, and the blades may be distributed from the hub at positions corresponding to the same hub diameter or different hub diameters.

The blades 122 may be arranged to have sloped edges 136. Each edge 136 extends at least partially between the base 129 and the terminal end 130 and is generally parallel with a plane intersecting the base 129 and the terminal end 130. The blades 122 may also have inner surfaces 133 that are generally parallel with the edges 136 and which have a non-perpendicular angle 135 relative to the rotational axis 32. Further, a gap 134 may separate each of the blades 122. It should be appreciated that the gap 134 has a longitudinal length that can be varied without being substantially limited by the number or shape of the blades 122. Optionally, a support ring 140 is fixed to the blades 122 at the terminal end 130 to provide rigidity for the rotor 100. When a support ring is fixed to the terminal ends of a plurality of blades distributed from the hub of the rotor, the support ring together with the blades and the hub may form a single unit, so the blades no longer have free terminal ends. The hub is defined by a first diameter, and the end distal to the hub is defined by a second larger diameter. The single unit has at least one opening between two of the incorporated blades. In a non-limiting embodiment, more than one support ring may be fixed to a plurality of blades distributed from the hub of the rotor. One support ring may be fixed to the terminal ends of the plurality of blades and one or more support rings may be fixed to the blades at positions intermittent between the hub and the end distal to the hub. The single unit has at least one opening between two of the incorporated blades. In another non-limiting embodiment, one or more support rings may be fixed to the blades only at positions intermittent between the hub and the end distal to the hub. In this arrangement there is at least one opening between two of the blade portions incorporated between the support rings, the blade portions not incorporated between the support rings having terminal ends. While four blades 122 are shown, a rotor 100 may use any number of blades 122; e.g., one, two, five, etc.

Referring to FIG. 3, there is shown the rotor 120 telescopically arranged with the stator 150. In this arrangement, the stator 150 is a non-limiting example of a first member and the rotor 120 is a non-limiting example of a second member. The stator 150 may be a body 152 having an inner chamber 154 in which the rotor 120 is disposed. The stator 150 also includes one or more channels 156 that guide fluid through the body 152 and into the chamber 154. While shown as cylindrical, the stator 150 may have any shape. The channel(s) 156 are openings in the body 152 that form one or more fluid streams that can be sheared by the blade(s) 122. While the rotor 120 is shown internal to the stator 150, other embodiments may position the rotor 120 external to the stator 150. Also, the fluid may flow in either direction.

In the FIG. 3 arrangement, the gaps 134 and the channels 156 are shown as having generally the same size and shape. However, the size and shape of the gaps 134 and the channels 156 may also be dissimilar. For example, the gaps 134 may be sized to allow a blade 122 to fully block the channel 156 or to only partially block the channel 156. Additionally, there does not need to be a "one to one" correspondence between gaps 134 and channels 156. As a non-limiting example, there may be two channels 156 and five blades 122.

During operation, an actuator 180 may be used to rotate or oscillate the rotor 120. The actuator 180 may be a motor that is driven electrically, electromechanically, hydraulically, pneumatically, or by any other suitable mechanism or energy source. This motion causes the blades 122 to partially or completely block one or more channels 156. The partial or complete blockage increases pressure in the flowing fluid and forms a pressure pulse of sufficient amplitude to be detected at a remote location at the surface or downhole.

In other aspects, the present disclosure provides a valve that has one or more features for allowing relatively large particles, such as solids or lost circulation material (LCM), to pass through without clogging internal passage ways. These features may be used with conical shaped rotors or rotors having other shapes.

Figure 4A:
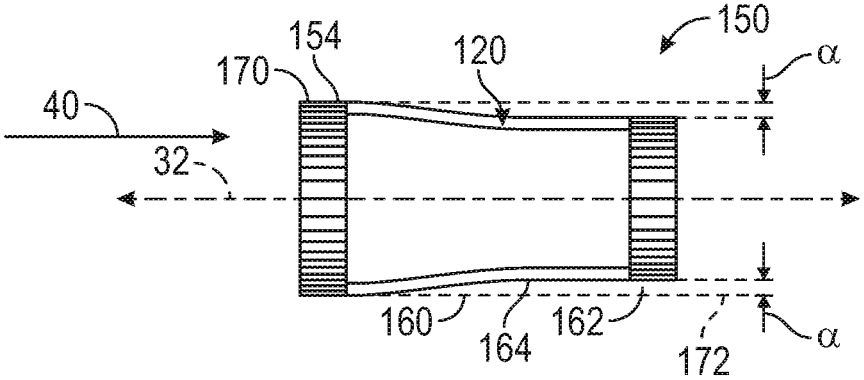
FIGS. 4A-B schematically illustrate valve configurations that use gaps to pass solids entrained in the liquid in accordance with one embodiment of the present disclosure.
Figure 4B:
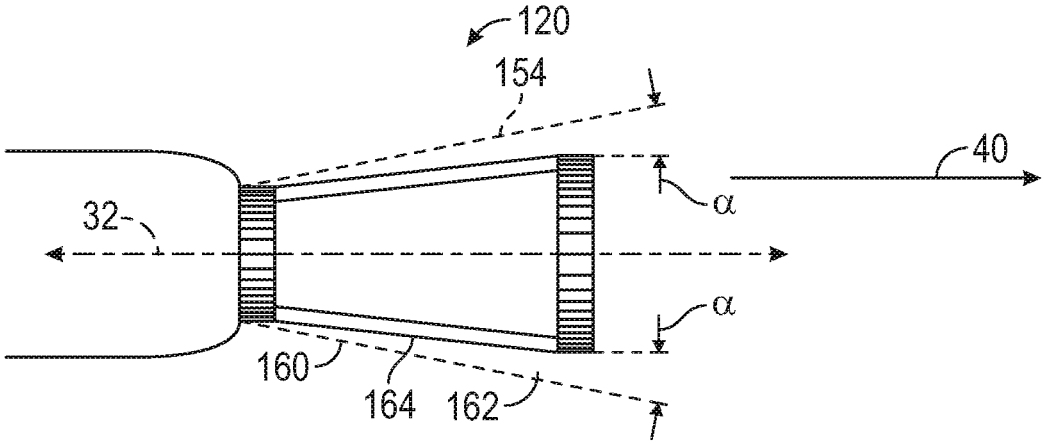

Referring to FIGS. 4A,B, one feature for allowing passage of solids entrained in a flowing fluid is to implement a gap between the rotor 120 and the stator 150. In FIG. 4A, there is shown a rotor 120 positioned in a chamber 154 of a stator 150. The chamber 154 may be defined, in part, by a inner surface 160. The inner surface 160 may shaped complementary with the rotor 120. Thus, if the rotor 120 is cylindrical or conical, then the inner surface 160 may also be cylindrical or conical. In FIG. 4A, a gap 162 separating the inner surface 160 and an outer surface 164 of the rotor 120 may be constant along the rotational axis 32. In FIG. 4B, the gap 162 separating the inner surface 160 and an outer surface 164 of the rotor 120 may increase along the rotational axis 32. The fluid flows in a direction 40 such that the fluid encounters the gradual increase in gap size. The increase may be gradual as shown, non-linear, or discontinuous, e.g., stepped. Referring to FIG. 4B, during use, solids trapped at an entry point 170 (not shown in FIG. 4B) into the rotor 120 may be pushed by fluid pressure through the gap 162. Advantageously, the increasing gap size reduces the resistance to the solids, which may allow the solids to pass through to the exit point 172 (not shown in FIG. 4B) out of the valve 100.

Figure 5:
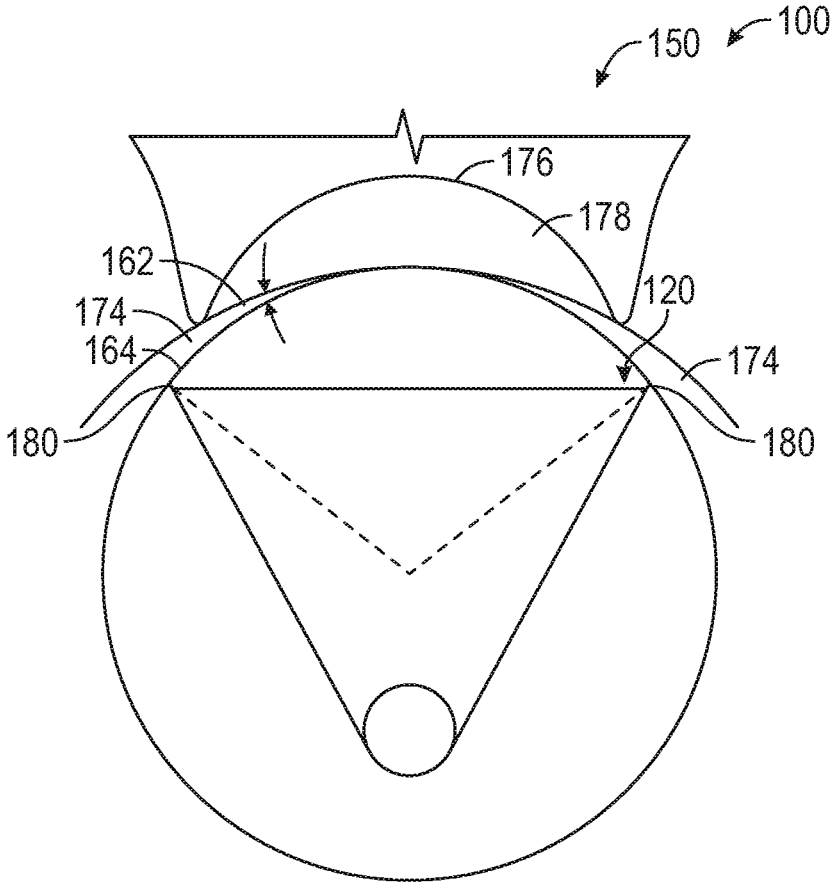
FIG. 5 schematically illustrates another valve configuration that uses gaps to pass solids entrained in the liquid in accordance with embodiments of the present disclosure.

Referring to FIG. 5, another gap for allowing passage of solids entrained in a flowing fluid may be formed by varying a cross-sectional profile of the rotor 120 and/or the stator 150. For example, the rotor 120 may have an outer surface 164 that faces an inner surface 160 of the stator 150. The surfaces 160, 164 may be shaped and oriented to form gaps through which solids may pass. In one embodiment, the inner surface 160 is partially defined by a circle having a first radius and the outer surface 164 is defined by a second radius that is smaller than the first radius. Thus, gaps 174 that increase in size are formed on the sides of the rotor 120. The gaps 174 are the largest at the edges 180. During rotation of the rotor 120, the size of the gap at an edge 180 varies from large to small and then to large again due to the difference in radii.

FIG. 5 also illustrates an undercut 176 that may be used to form a gap for passing solids. The undercut 176 may be used independently of the varying radii shown in FIG. 5. The undercut 176 may be a longitudinal concave recess formed along the inner surface 160. When the rotor 120 is positioned beneath the undercut 176 as shown, a gap 178 is formed between the rotor 120 and the stator 150. The size of the gap 178 is selected to be larger than the largest size of solids in the flowing fluid to prevent such solids from clogging the valve 100 (FIG. 3). The undercut 176 may be shorter, the same size or longer than the rotor 120.

Figure 6:
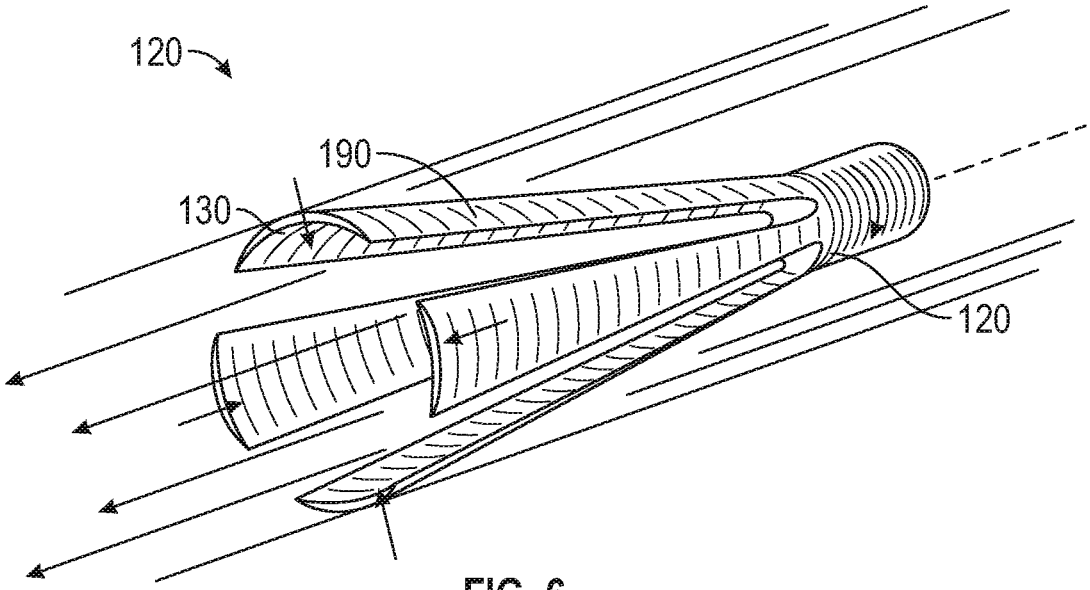
FIG. 6 schematically illustrates a valve configuration that uses flexible rotor portions to pass solids entrained in the liquid in accordance with one embodiment of the present disclosure.

Referring to FIG. 6, there is shown another feature for allowing passage of solids entrained in a flowing fluid by making one or more portions of the rotor 120 flexible. For example, the rotor 120 may comprise one or more flexible blades 190. The blades 190 may be configured to flex to form or enlarge a gap between the blade 190 and the adjacent inner surface of a stator 150 (FIG. 3). The flexure is sufficient to form a gap of sufficient size to allow solids of a predetermined size to pass. In one arrangement, the flexure is radial such that one or more terminal ends bend inward. In other embodiments, the flexure may be twisting or bowing to cause a bend at a middle of the blade 122. In other embodiments, the flexure may also be circumferential to increase or vary the size of the gaps between the blades. During operation, solids, or lost circulation material, may accumulate in the valve 100 (FIG. 3). This accumulation reduces the available flow area and thus increases the pressure differential across the valve 100. Once the pressure differential is sufficiently high, one or more of the blades 190 bend to form or increase gaps that allows the accumulated solids to pass.

Figure 7A:
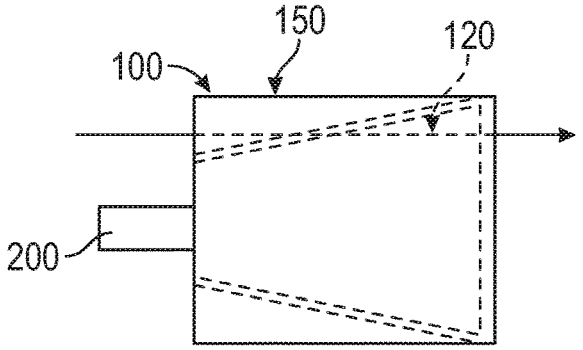
FIGS. 7A-B schematically illustrate a valve configuration that uses a movable rotor portion to pass solids entrained in the liquid in accordance with one embodiment of the present disclosure.
Figure 7B:
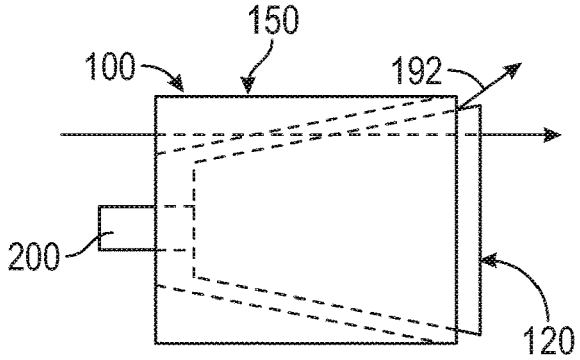

Referring to FIGS. 7A, B, there is shown another feature according to the present disclosure for allowing solids to pass through the valve 100. In this arrangement, the valve 100 includes a stator 150, a moveable rotor 120, and an actuator 200. The actuator 200 may be used to axially slide the rotor 120 in the direction indicated by the arrow. The actuator 200 may be any of those previously described. The same or separate actuator may be used to rotate the rotor 120. During operation, either in response to a command signal from a remote location (e.g., the surface) or a downhole tool, on a preprogrammed time period (e.g., every thirty minutes), or other scheme, the actuator 200 axially displaces the rotor 120 in the direction indicated by the arrow to form a gap 192 through which solids may pass. The actuator 200 may then retract the rotor 120 to reduce or close the gap 192.

Figure 8A:
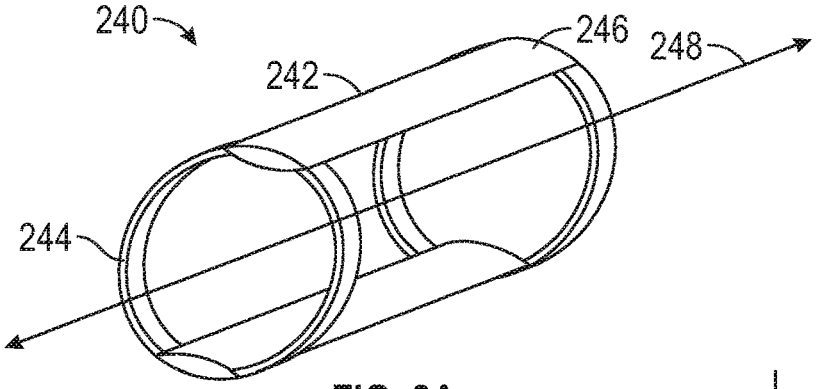
FIGS. 8A-C schematically illustrate blade shapes in accordance with embodiments of the present disclosure.
Figure 8B:
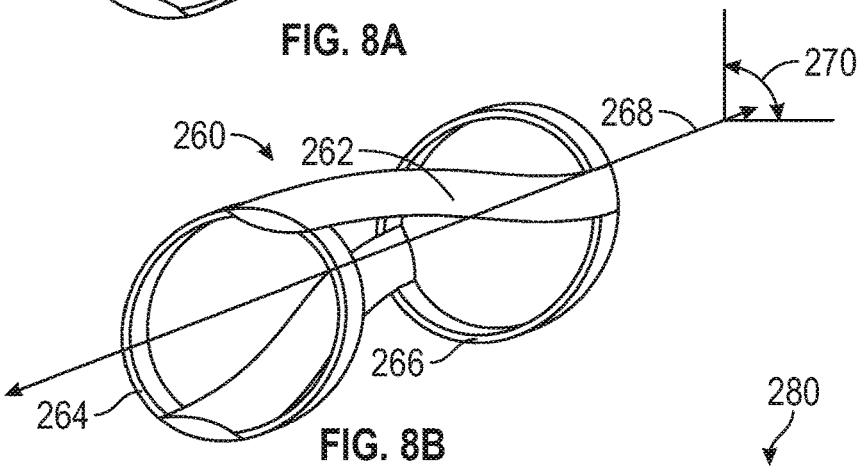
Figure 8C:
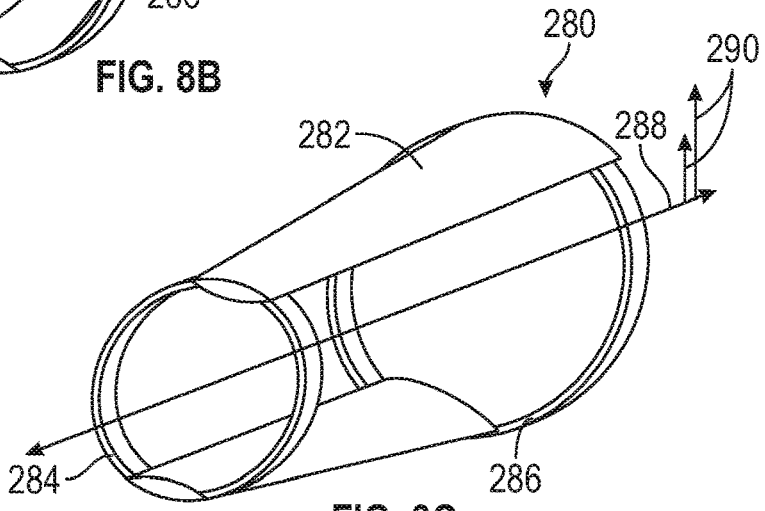

Referring to FIGS. 8A-C, there are illustrated various non-limiting shapes for second members that are constructed as blades according to the present disclosure. FIG. 8A illustrates an assembly 240 wherein one or more straight blades 242 have opposing ends connected to rings 244 and 246. By "straight," it is meant that the edges along elongated sides are parallel in a generally rectangular fashion such that the opposing ends are circumferentially and radially aligned. It should be noted that the term "straight" refers to the geometry of the blade 242 along a longitudinal axis 248. The surfaces of the blades 242 may have curvatures relative to other axes or planes.

FIG. 8B illustrates an assembly 260 wherein one or more twisted blades 262 have opposing ends connected to rings 264 and 266. By "twisted," it is meant that the blade geometry employs a bend or twist such that the opposing ends are circumferentially offset but radially aligned. Its circumferential offset may be with reference to a longitudinal axis 268. An exemplary offset 270 is shown.

FIG. 8C illustrates an assembly 280 wherein one or more curved blades 282 have opposing ends connected to rings 284 and 286. By "curved," it is meant that the blade geometry employs a curvature such that the opposing ends are circumferentially aligned but radially offset. It should be understood that blades according to the present disclosure may use hybrid or blended geometries that incorporate the geometric features illustrated in FIGS. 8A-C. Circumferential alignment or misalignment refers to an angular offset relative to a circumference of a ring and radial alignment or misalignment refers to a distance as measured along a radius from a center line of a ring. Its radial offset may be with reference to a longitudinal axis 288. An exemplary offset 290 is shown.

While the assemblies in FIGS. 8A-C illustrate the use of two rings, other embodiments may use one ring or three or more rings. Likewise, while two blades are shown, it should be understood that assemblies may include one blade or three or more blades. Further, all of the blades do not have to employ the same geometric features. For example, an assembly may include one or more blades of each of the blades illustrated in FIGS. 8A-C.

Figure 9:
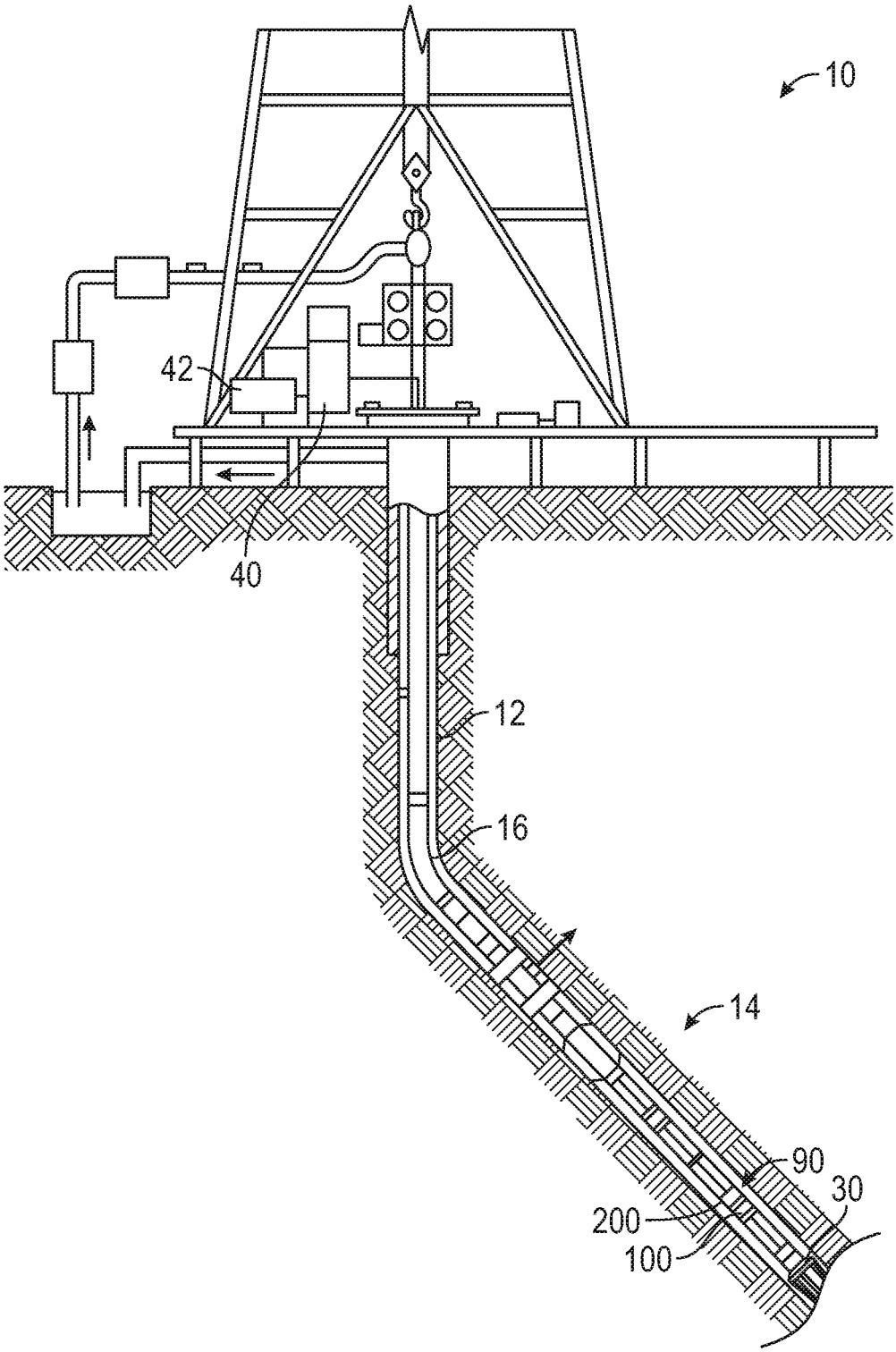
FIG. 9 schematically illustrates a drilling system that may use a valve in accordance with one embodiment of the present disclosure.

Referring now to FIG. 9 there is schematically illustrated a drilling system 10 that may include a pulse generator 90 according to aspects of the present disclosure. As discussed above, the pulse generator 90 uses a valve 100 driven by an actuator 200 to generate pressure pulses in a fluid circulating in a borehole 12. While a land system is shown, the teachings of the present disclosure may also be utilized in offshore or subsea applications. A drilling system 10 may have a bottom hole assembly (BHA) or drilling assembly 14 that is conveyed via a string 16 (or 'drill string') into the borehole 12. The tubing 16 may include a rigid carrier, such as jointed drill pipe or coiled tubing, and may include embedded conductors for power and/or data for providing signal and/or power communication between the surface and downhole equipment. The BHA 14 may include a drilling motor 18 for rotating a drill bit 30. The BHA 14 includes hardware and software to provide downhole "intelligence" that processes measured and preprogrammed data and writes the results to an on-board memory and/or transmits the results to the surface. For transmission to the surface, data is typically encoded pursuant to a selected communication protocol. Any of a wide variety of communication protocols for communicating data through a pulse series can be implemented, including frequency-shift keying (FSK), phase-shift keying (PSK), amplitude-shift keying (ASK), and combinations of the above, as well as other communication protocols. Processors disposed in BHA 14 may be operatively coupled to one or more downhole sensors that supply measurements for selected parameters of interest including BHA 14 or drill string 16 orientation, formation parameters, and borehole parameters.

In one arrangement, the drilling system 10 may include a pulse detector 40 at a surface location. The pulse detector 40 may include a fluid and pressure sensor (not shown) in fluid communication with the fluid being circulated into the borehole 12 and/or flowing out of the borehole 12. The pulse detector 40 may also include a suitable processor 42 and related electronics for decoding the sensed pressure pulses. During operation, the BHA 14 may control the actuator 200 to rotate or oscillate the valve 100 in order to impart pressure pulses into the flowing fluid.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. An apparatus for generating pressure variances in a fluid flowing in a downhole tool, comprising:

a first member having a body through which at least one channel is formed; and a second member arranged with the first member and including at least one opening, the second member configured to be displaceable about a rotational axis between a first position in which at least one section of the second member at least partially blocks a flow of the fluid between the at least one opening and the at least one channel of the first member, and a second position in which the at least partial blockage of the flow between the at least one opening and the at least one channel is reduced by the at least one section of the second member;

wherein the second member has a hub and the at least one section extends axially and radially inside an inner chamber of the first member from the hub relative to the rotational axis of the second member, and wherein the at least one channel and the at least one opening taper in a same axial direction, and the at least one opening tapers toward the hub relative to the rotational axis of the second member.

2. The apparatus of claim 1, wherein the at least one section extends at a non-perpendicular angle relative to the rotational axis of the second member.

3. The apparatus of claim 1, further comprising an actuator connected to the second member, the actuator being configured to at least partially block the flow of the fluid through the at least one channel by rotating the second member relative to the first member, or by oscillating the second member relative to the first member.

4. The apparatus of claim 1, wherein the at least one section comprises at least one blade having at least one edge extending between a base and a terminal end of the at least one blade, the at least one blade being oriented to shear the fluid flowing through the at least one channel.

5. The apparatus of claim 4, wherein the hub is defined by a first diameter, and the terminal end is distal to the hub and is defined by a second larger diameter.

6. The apparatus of claim 1, wherein the second member has a plurality of blades distributed around the hub, the plurality of blades comprising:

a first blade having a base arrayed at a first diameter and a terminal end arrayed at a second larger diameter; and a second blade having a base arrayed at a third diameter and a terminal end arrayed at a fourth larger diameter;

wherein the first and third diameters can be the same or different;

the second and fourth diameters can be the same or different; and the second and fourth diameters are spaced apart along the rotational axis of the second member relative to the first and third diameters respectively.

7. The apparatus of claim 1, wherein the inner chamber is formed in the body, the second member is disposed in the inner chamber, the inner chamber is defined by an inner surface and the at least one section includes an outer surface that extends axially and radially relative to the rotational axis of the second member, and wherein a gap separates at least a portion of the inner surface and the outer surface.

8. The apparatus of claim 7, wherein the gap increases in size along the rotational axis of the second member.

9. The apparatus of claim 7, wherein the inner surface is at least partially defined by a first radius, and the outer surface is at least partially defined by a second radius that is smaller than the first radius, thereby forming the gap, the gap having a varying size between the inner surface and the outer surface.

10. The apparatus of claim 7, wherein the inner surface includes a concave recess elongated along the rotational axis, the recess forming the gap.

11. The apparatus of claim 7, wherein the at least one section is a blade configured to flex to limit a size of the gap.

12. The apparatus of claim 7, further comprising an actuator connected to the first member or the second member, the actuator being configured to axially move the first member or the second member to define the gap separating at least a portion of the inner surface and the outer surface.

13. The apparatus of claim 1, wherein the first member and the second member are positioned in a wellbore, and further comprising a pressure sensor at a surface location for detecting the pressure variances in a fluid circulating in the wellbore.

14. The apparatus of claim 1, wherein the at least one channel is configured to allow passage of lost circulation material.

15. A method for generating pressure variances in a fluid flowing in a downhole tool, comprising:

guiding the fluid across a first member using at least one channel formed between an inner surface and an outer surface of the first member;

arranging a second member with the first member, the second member having at least one opening;

selectively blocking a flow of the fluid between the at least one opening and the at least one channel using at least one section of the second member, the at least one section extending axially and radially inside an inner chamber of the first member from a hub of the second member relative to a rotational axis of the second member; and moving the second member using an actuator to reduce the blockage of the flow of the fluid through the at least one channel, wherein the at least one channel and the at least one opening taper in a same axial direction, and the at least one opening tapers toward the hub relative to the rotational axis of the second member.

16. The method of claim 15, wherein the second member at least partially blocks the flow of the fluid through the at least one channel during one of: (i) a rotation relative to the first member, and (ii) an oscillation relative to the first member.

17. The method of claim 15, wherein the at least one section comprises at least one blade having at least one edge extending between a base and a terminal end of the at least one blade, the at least one blade being oriented to shear the fluid flowing through the at least one channel.

18. The method of claim 17, wherein the hub is defined by a first diameter, and the terminal end is distal to the hub and is defined by a second larger diameter.

19. The method of claim 15, wherein the fluid is drilling mud, and further comprising:

performing mud pulse telemetry using the pressure variances.

20. The method of claim 15, further comprising passing a lost circulation material along the at least one channel.

* * * * *